United States Patent [19]

Rastas et al.

[11] 4,385,038

[45] May 24, 1983

[54] FLOTATION RECOVERY OF LEAD, SILVER AND GOLD AS SULFIDES FROM ELECTROLYTIC ZINC PROCESS RESIDUES

[75] Inventors: Jussi K. Rastas, Pori; Kaarlo M. J. Saari; Väino V. H. Hintikka, both of Vanha-Ulvila; Jaakko O. Leppinen, Vammala; Aimo E. Järvinen, Kokkola, all of Finland

[73] Assignee: Outokumpu Oy, Helsinki, Finland

[21] Appl. No.: 306,707

[22] Filed: Sep. 29, 1981

[30] Foreign Application Priority Data

Sep. 30, 1980 [FI] Finland ..... 803096

[51] Int. Cl.[3] ..... B03D 1/06

[52] U.S. Cl. ..... 423/26; 423/48; 423/89; 423/109; 209/166; 209/167

[58] Field of Search ..... 423/26, 109; 75/2; 209/166, 167

[56] References Cited

U.S. PATENT DOCUMENTS 1,197,590 9/1916 Bacon ..... 423/26
3,968,032 7/1976 Menendez ..... 423/26

FOREIGN PATENT DOCUMENTS 2620654 12/1976 Fed. Rep. of Germany ..... 423/26

*Primary Examiner*—Brian E. Hearn
*Attorney, Agent, or Firm*—Brooks, Haidt, Haffner & Delahunty

[57] ABSTRACT

A process is disclosed for the recovery of lead, silver and gold from the iron-bearing residue of an electrolytic zinc process by froth-flotating a slurry of the iron-bearing residue in the presence of a sulfidic collector agent in order to froth-flotate the sulfides and to separate them from the iron-bearing residue. The iron-bearing residue is sulfidized selectively in order to convert the lead, silver and possibly gold substantially quantitatively to sulfides before the iron-bearing residue is froth-flotated.

8 Claims, 1 Drawing Figure

LEGEND:

| | | | |
|---|---|---|---|
| RA | RETURN ACID | SE | SEPARATION OF SOLID AND SOLUTION |
| C | CALCINE | S | SULFIDIZATION STAGE |
| NL | NEUTRAL LEACH STAGE | F | FROTH-FLOTATION STAGE |
| RS | RAW SOLUTION | CS | CONVERSION STAGE |
| J | JAROSITE | SA | SULFURIC ACID; $NH_3$, $(NH_4)_2SO_4$ OR $Na_2SO_4$ |
| ReS | RETURN SOLUTION | | |

SOLID PHASE

SOLUTION PHASE

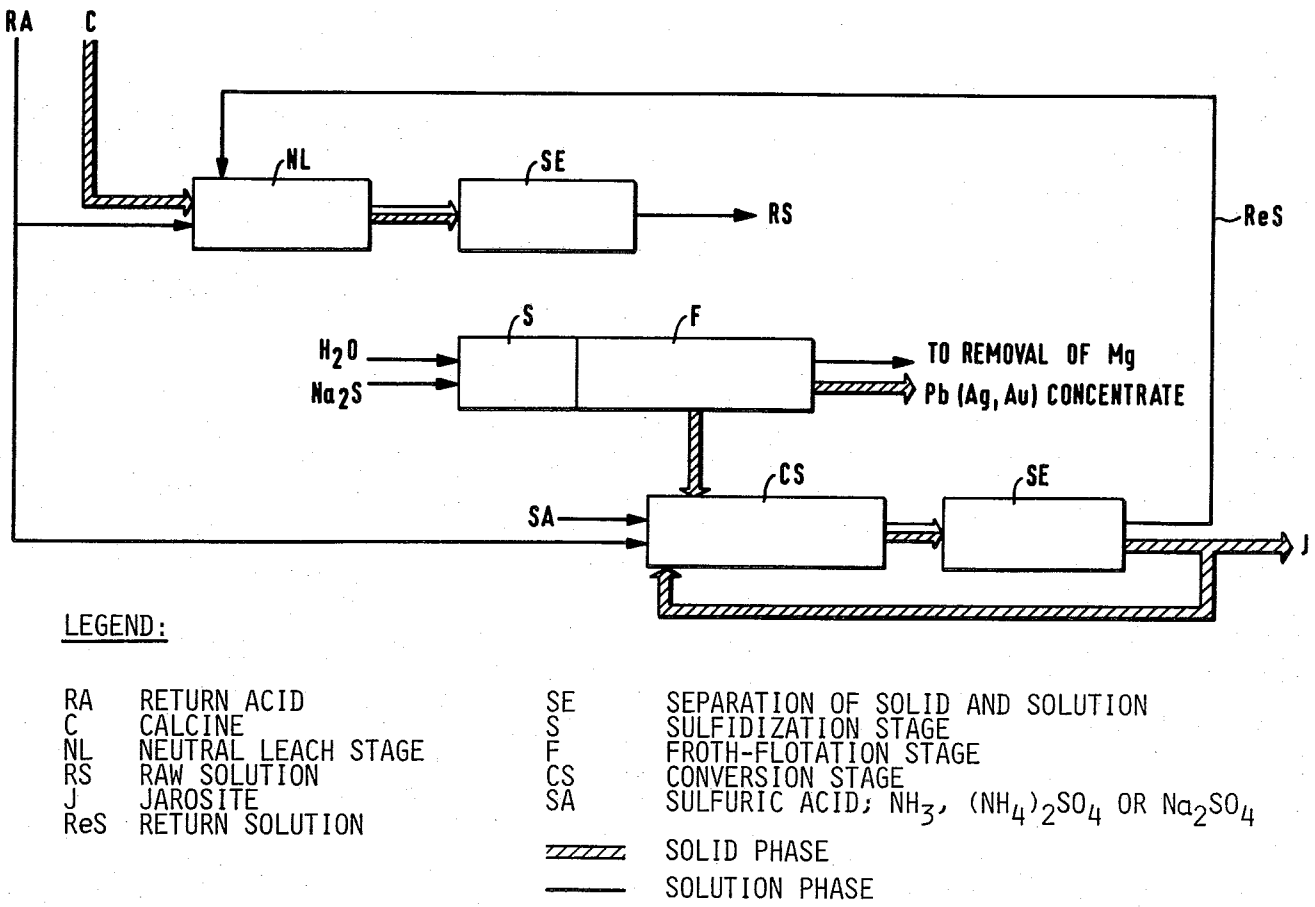
RA
C
NL
SE
RS
ReS
S
F
$H_2O$
$Na_2S$
TO REMOVAL OF Mg
Pb (Ag, Au) CONCENTRATE
SA
CS
SE
J
LEGEND:
RA RETURN ACID
C CALCINE
NL NEUTRAL LEACH STAGE
RS RAW SOLUTION
J JAROSITE
ReS RETURN SOLUTION
SE SEPARATION OF SOLID AND SOLUTION
S SULFIDIZATION STAGE
F FROTH-FLOTATION STAGE
CS CONVERSION STAGE
SA SULFURIC ACID; $NH_3$, $(NH_4)_2SO_4$ OR $Na_2SO_4$
SOLID PHASE
SOLUTION PHASE

FLOTATION RECOVERY OF LEAD, SILVER AND GOLD AS SULFIDES FROM ELECTROLYTIC ZINC PROCESS RESIDUES

BACKGROUND OF THE INVENTION

The present invention relates to a process by which, in connection with an electrolytic zinc process and particularly the leaching process for zinc calcine, the recovery of lead, silver and gold from the iron-bearing residue is also effected in addition to a high recovery of zinc, copper and cadmium, in an economical and simple manner.

The starting material of an electrolytic zinc process is a sulfidic zinc concentrate, from which an oxidic product, zinc calcine, is obtained by roasting. This calcine contains, in addition to the principal constituent, zinc oxide, practically all of the iron of the original concentrate, combined with zinc as zinc ferrite. The iron content in the concentrate usually varies between 5 and 15%, depending on the concentrate. An iron content of about 10% in the concentrate represents a typical value of currently used raw materials. This means that about 10% of the zinc of the concentrate is bound in zinc ferrite, $ZnFe_2O_4$, the content of which in this typical case is 21.5% of the total amount of calcine.

In addition to zinc, the zinc concentrate also contains other valuable metals such as Cu, Cd, Pb, Ag and Au, and the recovery of these metals is of considerable significance for the total economy of the zinc process. However, in planning a zinc process or in modifying a process, it is necessary to take into account the behavior of several elements present in the concentrate in the process. Some of these elements (Zn, S, Cu, Cd, Pb, Ag, Au) are of primary importance for the economy of the zinc process, whereas others (Fe, Cu, Ni, Ge, Tl, In, Ca, Mg, Mn, Cl, F) have less or no economic importance but have to be taken into account precisely, with regard to the functioning of the process. In addition, there are elements which are significant in terms of environmental protection (S, Hg, Se), the quality of the byproducts (Hg, Se, As, Sb, Sn), or waste formation (Fe, Si, Al, Ca).

It is of primary importance for the economy of the process that the recovery of zinc is high. In a process alternative which can be considered good at present, the target set for the recovery of zinc must be at minimum 97–98%, and also there must be a maximally good recovery of the above-mentioned valuable elements in a saleable form.

The following approximate values can be taken as average valuable-metal contents in a typical zinc concentrate: Zn 53%, Cu 0.5%, Cd 0.2%, Pb 1%, Ag 60 g/t, Au 0.5 g/t. This means that, at the current prices of the products, the total value content of copper and cadmium jointly is 4–5%, that of lead, silver and gold 8–10%, and, furthermore, the value of sulfur calculated as sulfuric acid 5–6%; i.e. the value content of the byproducts is approximately 20% of the value of zinc, which is the principal product of the process. Thus it is evident that a maximal recovery of the said byproducts is also essential for a competitive process.

As regards the said harmful elements, especially iron, its recovery does not have special economic importance (the value of the iron as iron ore is about 0.2% of the value of the zinc); instead, the iron compounds formed during the process often cause a waste problem difficult to solve.

Prior to 1965, it was common in an electrolytic zinc process to recover the zinc present primarily as zinc oxide and zinc sulfate by means of a dilute acid leach, whereas the undissolved ferritic material constituted a leach residue, which in several cases was directed to waste disposal areas. In such cases, zinc, copper and cadmium bound in the ferrite, as well as lead, silver and gold which remained in the form of insoluble compounds under the leaching conditions were also lost in the waste disposal area along with the iron detrimental to the process. At that time, the degrees of recovery of the metals were typically 87–89% for zinc, approx. 50% for copper, 50–60% for cadmium, and 0% for lead, silver and gold. The amount of ferritic leach residue was on the average approximately one-third of the amount of calcine fed into the process. The said procedure was applied, since a suitable method was not known for the separation of the large iron amounts present in the calcine.

An essential improvement in this respect was provided by the patent applications filed in 1965 by Steintveit and by Haigh & Pickering (Norwegian Pat. No. 108047 and Australian Pat. No. 401 724). In the processes disclosed in these patent applications, the ferrites were leached and the iron was precipitated in the form of well-settling and filtrable jarosite compound. In the former process, the iron was precipitated under atmospheric conditions by using the zinc oxide of the zinc calcine for the neutralization of the sulfuric acid produced during the precipitation. In the latter process, the iron was precipitated in an autoclave, without neutralization. The jarosite process as a process in accordance with the former patent, supplemented with an acid wash (Norwegian Pat. No. 123 248), has found extensive use in the zinc industry. The process is described, for example, in G. Steintveit's article "Die Eisenfällung als Jarosit und ihre Anwendung in der Nassmetallurgie des Zinks", Erzmetall 23 (1970) 532–539.

In the jarosite process, the yield of zinc rises to 97–98%, the yield of cadmium to 90–95%, the yield of copper to 80–90%, and the yields of lead, silver and gold to 70–80%. A jarosite precipitate, the iron content of which is approximately 30% an amount somewhat less than 30% of the amount of calcine fed into the process, is removed from the process. The precipitate often—especially owing to its high annual output—constitutes a waste problem for the industrial establishment concerned. A leach residue which contains most of the lead, silver and gold of the concentrate is removed from the leaching stage of the process. The amount of the leach residue is usually approximately 5% of the amount of the calcine feed. The lead content in the residue is usually approximately 20%. The low head content of such a leach residue and its oxidic and sulfatic composition have lowered its commercial value, and therefore it is understandable why earlier, at a time of a relatively low price level of lead and noble metals, it did not offer an especially interesting material for processing and was in many cases directed to the waste disposal area together with the jarosite precipitate.

Soon after the emergence of the jarosite process, Societe de la Vieille Montagne developed the goethite process (Belgian Pat. No. 724 214). It differs from the jarosite process as regards the iron reduction stage ($Fe^{3+} \rightarrow Fe^{2+}$) and the iron precipitation stage. The iron is precipitated as goethite by using the zinc oxide of the zinc calcine for the neutralization of the sulfuric acid produced during the precipitation.

The metal yields of the goethite process are in the main the same as those of the jarosite process. The iron precipitate and the leach residue are removed from the process. The latter is similar to the leach residue of the jarosite process in both quality and quantity. The iron precipitate is in this case goethite-based, and its iron content is approximately 45–48%. Its amount is clearly less than that of the corresponding precipitate in the jarosite process, but even in this case it is nearly 20% of the amount of the zinc calcine feed. The goethite process has been described in the article by J. N. Andre and N. J. J. Masson "The Goethite Process in Retreating Zinc Leaching Residues", AIME Annual Meeting, Chicago, February 1973.

As is evident from the above brief descriptions of the processes, both the jarosite and the goethite process produce relatively large amounts of iron precipitate, which is not suitable for, for example, the production of crude iron without further treatment, and for which no other use has been found, but the precipitates have as a rule been directed to waste disposal areas.

The attempt to diminish the waste problem has lead to a search for process alternatives in which the iron can be separated in the form of sufficiently pure hematite with the purpose of channeling it to the iron industry as raw material. On this basis, there have been developed the hematite processes, in which the iron is precipitated as hematite out from the process solution during an autoclave stage. The first hematite process was developed by The Dowa Mining Company, and the process is in use at a zinc plant in Iijima, Japan. The process has been described in the article by S. Tsunoda, J. Maeshiro, E. Emi, K. Sekine "The Construction and Operation of the Iijima Electrolytic Zinc Plant", TMS Paper Selection AIME A-73-65 (1973).

Another hematite process was recently developed by Ruhr-Zink GmbH in the Federal Republic of Germany. The process has been described in DT-OS 26 24 657 and DT-OS 26 24 658 and in the article by A. von Röpenack "Die Bedeutung der Eisenfällung für die hydrometallurgische Zinkgewinnung, Erzmetall Bd 32 (1979) 272–276.

Outokumpu Oy has developed a process based on the utilization of jarosite compounds, i.e. the conversion process, in which special attention has been paid to a high recovery of zinc, copper and cadmium and to the simplification of the process for leaching the zinc calcine. The process has been in use at the Kokkola zinc plant of Outokumpu Oy since 1973. At the time that the process was adopted, the raw material of the plant was so low in lead, silver and gold that the recovery of these elements did not seem economically advisable at the then prevailing relative prices. On the other hand, it was viewed as advisable to aim at a maximally high recovery of the zinc, copper and cadmium present in the concentrate and at simplicity of the apparatus and the processing method. It was proven that by giving up the individual separation of the leach residue which contained lead and noble metals, normally carried out in connection with the previously described jarosite process, it was possible to combine the stages normally included in the jarosite process—ferrite leach, (preneutralization), jarosite precipitation and acid wash of jarosite precipitate—to form one stage in which the ferrite dissolves (consuming acid) and the iron simultaneously precipitates as jarosite (producing acid) and thereby to simplify the process of leaching zinc calcine. In this case the reactions (1) and (2) representing the phenomena occurring in the process (1) $3ZnFe_2O_{4(s)} + 12H_2SO_{4(aq)} \rightleftarrows 3ZnSO_{4(aq)} + 3Fe_2(SO_4)_{3(aq)} + 12H_2O_{(aq)}$ (2) $3Fe_2(SO_4)_{3(aq)} + Na_2SO_{4(aq)} + 12H_2O_{(aq)} \rightleftarrows 2NaFe_3(SO_4)_2(OH)_{(s)} + 6H_2SO_{4(aq)}$ (3) $3ZnFe_2O_{4(s)} + 6H_2SO_{4(aq)} + Na_2SO_{4(aq)} \rightleftarrows 2NaFe_3(SO_4)_2(OH)_{6(s)} + 37ZnSO_{4(aq)}$ are in mutual interaction and form a sum reaction (3), in which the zinc of the zinc ferrite passes into the solution and the iron is converted during the same stage via the solution to the jarosite phase. The leach yields and total yields of zinc are respectively 98–99% and 97.5–98.5%, and the total yields of copper and cadmium are 85–90%. The process is described in Finnish Patent Application 410/73 and in the articles by T-L Huggare, S. Fugleberg, J. Rastas "How Outokumpu Conversion process raises zinc recovery", World Min. (1974) 36–42 and by J. Rastas, S. Fugleberg, L-G Björkqvist, R-L Gisler "Kinetik der Ferritlangung und Jarositfällung" Erzmetall Bd. 32 (1979) 117–125.

On one hand, as the raw material range has come to contain more lead, silver and gold than previously, and on the other hand, as the changes in the relative prices of these metals—especially those of the noble metals—nowadays make it necessary to plan the leach process of the zinc calcine so that, in addition to a high recovery of zinc, copper and cadmium, a corresonding recovery is achieved also regarding lead, silver and gold.

In the jarosite and goethite processes summarized above, there is produced during a hot acid leaching stage a leach residue which no longer contains ferrites but contains all of the lead, silver and gold contained in the calcine fed to the neutral leaching stage. The lead content of this leach residue is in general relatively low, often about 20%. The low lead content of the residue and its oxidic and sulfatic composition decrease its commercial value. Therefore, it is understandable that processes by which the lead, silver and gold can be obtained in a more saleable form have been developed for the further treatment of this leach residue—originally intended for sale.

Asturiana De Zinc S. A. has, in its Finnish patent application No. 3435/70, disclosed a process in which the leach residue of the hot acid leach, produced in the manner described above, the lead being present in the residue as lead sulfate and silver as silver chloride and silver sulfide, is leached by means of a chloride-saturated and acidified solution in the presence of compounds which accelerate the oxidation of the metal sulfides present in the residues, such as copper chlorides, at a temperature which is between the ambient temperature and the boiling point of the solution, the leaching taking place in one or several stages. Thereby, both silver chloride and lead sulfate dissolve, forming silver and lead chloride complexes. The conversion of silver sulfide to silver chloride is promoted by additions of suitable reagents such as copper chloride. Both lead and silver can be separated from the solution as insoluble salts, such as sulfides, or by precipitating the metals successively out from the solution by using lead and zinc as cementing reagents.

Finnish patent application No. 761582 of Societe des Mines et Fonderies de Zinc de la Vieille Montagne relates to a process in which, on one hand, noble metals, especially silver, and on the other hand, lead are recovered from the leach residue of a hot acid leach, the residue no longer containing ferrite. The process is characterized in that the leach residue is slurried in water, the pH of the slurry is adjusted to between 1 and 5, a sulfide collector agent is added, and the slurry is froth-flotated. The products are, on one hand, a sulfide concentrate which contains silver, sulfides—above all, silver sulfide and zinc sulfide—and elemental sulfur, and on the other hand, a froth-flotation residue. The pH of the froth-flotation residue slurry is adjusted to between 1 and 4, an organic anionic collector agent is added, and the slurry is froth-flotated. The products obtained are a lead sulfate concentrate and a froth-flotation residue, which contains silica, iron oxides and calcium sulfate.

Finnish patent application No. 214/74 of Asturiana de Zinc S. A. also relates to a process in which lead and silver are recovered by froth-flotation from a leach residue which has been obtained from a hot acid leach of the neutral leach residue in a zinc process and no longer contains ferrites. The process is characterized in that, at first, most of the silver, sulfur and zinc are froth-flotated using suitable collector agents without sulfuring agents, the procedure is repeated on the froth-flotated product 1–3 times, whereby a concentrate concentrated with regard to silver, sulfur and zinc is obtained, whereas the residue is treated with an agent which activates the surface of lead sulfate, preferably sodium sulfide, whereby the surface of the lead sulfide present in the residue is activated, and when a suitable collector agent is added, the lead sulfate thus masked is froth-flotated. The procedure is repeated on the obtained product 1–3 times, whereafter the final lead sulfate concentrate is obtained.

A Japanese company, Mitsubishi Metal Corporation, disigned as early as 1961 a process for the recovery of silver by froth-flotation from the ferritic leach residue of the leaching of zinc calcine. The ferritic leach residue is produced by treating the neutral leach residue under mildly acidic conditions (pH=1.8), whereby the free zinc oxide dissolves, and the zinc ferrite remains undissolved. The process is described briefly in the article by A. Moriyma, Y. Yamamoto "Akita Electrolytic Zinc Plant and Residue Treatment of Mitsubishi Metal Mining Company, Ltd.", AIME World Symposium on Mining & Metallurgy of Lead and Zinc, Vol. II, 1970, 198–222. The process has been described later—in the form it was at that time and in greater detail than described previously—in the article by Y. Yamamoto "Silver Recovery from Zinc Residue", TMS Paper Selection AIME A 77—18 (1977). According to the method, the ferritic leach residue is slurried in water, a sulfide collector agent and a frothing agent are added to the slurry, and the slurry is froth-flotated. Primarily the sulfidic phases of the ferritic leach residue, sphalerite (ZnS) and argentite ($Ag_2S$), rise into the froth. The yields of silver and gold by the method are respectively 75–80% and 30–35%.

An examination of the methods for the recovery of lead an silver implemented or suggested in connection with processes for leaching zinc calcine shows that the process alternatives disclosed in Finnish patent applications No. 3435/70, 761582 and 214/74 relate to the further treatment of a leach residue—which is a leach residue from a hot acid leach of a neutral leach residue—and that the methods are thus connected with the use of multiple-stage jarosite and goethite processes. When a further treatment of the residue from a hot acid leach, or often also a further treatment of a material called the strong acid leach residue, by means of either chloride leaching or froth-flotation is added to these processes, an entity consisting of several partial processes is obtained, and the difficulties encountered in the technical control of the process are in proportion to the complexity of the total process.

The process of Mitsubishi Metal Corporation relates to a ferritic leach residue and, within it, specifically to the recovery of silver. This recovery is carried out by means of a direct froth-flotation of the leach residue. The lead present in the leach residue cannot be recovered by the process, the recovery of gold is low, 30–35%, and the recovery of silver also remains between 75 and 80%.

If we examine the process according to Finnish patent application no. 410/73 of Outokumpu Oy, we see that the technical implementation of the leach process is simple in terms of both the apparatus and the process control. It has a deficiency in that the lead, silver and gold present in the concentrate cannot be recovered by means of it, and these elements pass to the waste disposal area along with the jarosite precipitate. The present process is an improvement which eliminates this deficiency of Finnish patent application No. 410/73.

It has now surprisingly been observed that lead, silver and gold can be sulfidized selectively from a ferritic residue without simultaneous sulfidization of the zinc present in the solution and without substantial simultaneous dissolving of ferrite.

SUMMARY OF THE INVENTION

According to the present invention the ferritic leach residue taken from the neutral leach stage is thus directed to a sulfidization stage, in which the lead of the lead sulfate present in the leach residue and the silver of the silver compounds present in the leach residue, such as silver chloride, are sulfidized completely in a closed reactor by using an amount of sulfide equivalent as regards lead and silver. The sulfidizing agent used can be $Na_2S$, $Ca(HS)_2$ or $H_2S$. The sulfidizing reactions occurring in the closed reactor or reactors—the sulfidizing agent being sodium sulfide—are as follows:

(4) $PbSO_{4(s)}+Na_2S_{(aq)} \rightleftarrows PbS_{(s)}+Na_2SO_{4(aq)}$ (5) $2AgCl_{(s)}+Na_2S_{(aq)} \rightleftarrows Ag_2S_{(s)}+2NaCl_{(aq)}$.

From the sulfidization stage the slurry is directed to the froth-flotation stage, in which the sulfides are froth-flotated using sulfide collectors, depressors for oxidic material, and frothers. The aim is to carry out the froth-flotation in such a manner and under such conditions that primarily $Ag_2S$ and PbS rise into the froth. In general, the uncalcined zinc sulfide present in the ferritic leach residue and the zinc sulfide possibly produced during the sulfidization stage rise into the sulfidic froth.

Some of the advantages gained by means of the invention are that the ferrite need not be leached before the froth-flotation of the lead, silver and gold and that these valuable elements can be substantially quantitatively recovered as a combined concentrate.

During the froth-flotation stage, the sulfidic, the ferritic and the solution phase are separated from each other. The ferritic phase, which also contains the gangue of the calcine and the gypsum produced during the process, are directed to a conversion stage according to Finnish Patent Application 410/73; also fed to the conversion stage are such amounts of sulfuric acid, $NH_3$, $(NH_4)_2SO_4$ or $Na_2SO_4$ that they are equivalent in relation to the ferrite amount arriving in the stage in accordance with Reaction (3) and, furthermore, so proportioned that at the end of the stage the concentration of sulfuric acid remains at 15–80 g/l, preferably at 30–50 g/l, and the concentration of $NH_4$ or Na remains at 3–5 g/l.

DESCRIPTION OF THE DRAWING

The FIGURE illustrates diagrammatically the flow of the process according to the present invention, i.e. the manner in which the sulfidizing and froth-flotation stages for the ferritic leach residue are linked to the process according to Finnish patent application No. 410/73. The FIGURE also shows the cycling, within the conversion stage, of jarosite in accordance with Finnish patent application No. 760486, the cycling enhancing the operation of the conversion stage in the manner described in the said patent application and also in the article by J. Rastas, S. Fugleberg, L-G Björkqvist, R-L Gisler "Kinetik der Ferritlaugung und Jarositfallung", Erzmetall Bd. 32 (1979) 117–125.

DESCRIPTION OF THE PREFERRED EMBODIMENT

When the zinc oxide and zinc sulfate phases are leached out from the zinc calcine, a ferritic leach residue is left. The ferritic leach residue contains the zinc ferrite of the calcine, the uncalcined zinc sulfide and the secondary components of the calcine which are insoluble under the leaching conditions or are converted to insoluble compounds under the leaching conditions, such as lead sulfate, silver compounds, gypsum, silicates and silica. Such a selective leach can be carried out by means of the sulfuric-acid-bearing return acid solution of the process by adjusting the pH to between 1.5 and 2.5 during the leach.

A suitable leaching temperature is 70°–95° C. In practice, a ferritic leach residue is obtained, for example, by means of a two-stage countercurrent neutral leach, as disclosed in Finnish patent application No. 410/73, or by means of a two-stage cocurrent neutral leach. In this latter alternative, the zinc oxide and zinc sulfate phases are leached out selectively from the calcine under the leaching conditions mentioned above. After the leach, the solid phase, i.e. the ferritic leach residue, is separated. It is washed and directed to a sulfidization stage, in which the lead and silver present in the ferritic leach residue in the form of poorly soluble compounds, are sulfidized. The solution phase separated from the ferritic leach residue is neutralized to a pH of 4–5 by means of a small amount of zinc calcine. The solid phase remaining after this stage is separated by settling and is returned to the preceding leaching stage for zinc oxide. The solution, which is in general called the raw solution, is directed to solution purification.

The ferritic leach residue is sulfidized in closed reactors, into which there is fed a sulfide amount, for example in the form of a solution of sodium sulfide or calcium hydrosulfide, equivalent with regard to lead and silver in accordance with reactions (4) and (5). The reactors are dimensioned in relation to the slurry feed rate so that the retention of the slurry in the reactors, i.e. the sulfide precipitation time, is suitable. The aim of controlling the precipitation rate—by adjusting the precipitation rate to a sufficiently low level—and of using lead and silver sulfide nuclei is to ensure that lead sulfide and silver sulfide are precipitated on existing lead sulfide and silver sulfide nuclei without the sulfides forming impervious sulfide films around the original lead and silver compounds. Furthermore, the number of nuclei, the temperature, and the control of the pH of the solution and the precipitation rate can be used for affecting the size of the sulfide particles. By controlling the pH and the sulfide feed it is possible to eliminate, for the most part, the undesirable precipitation of zinc sulfide. The purpose of the sulfidization is to convert completely to sulfide form the lead and silver, which are present in the ferritic leach residue in the form of poorly soluble compounds. The air during the froth-flotation stage for the sulfidized ferritic leach residue is to find froth-flotation conditions which allow the sulfides of lead and silver to pass, as completely as possible, into the frothed concentrate.

When the material which contains noble metals and lead has been sulfidized in accordance with the invention, the abovementioned valuable metals are recovered by a froth-flotation method known per se, the pH range being acid, preferably 2–4. The slurry from the sulfidization treatment is directed, after its pH has been adjusted to the desired range, to a preparation stage, to which a known sulfide collector (xanthate, dithiophosphate, thiocarbamate, or the like) is added. A small amount of a frothing agent (e.g. triethoxy butane, TEB) and a possibly needed modifying chemical (which reduces surface activity) are added at the same time with the collector agent. After the preparation the said slurry is directed into a froth-flotation cell battery, in which the valuable metals are obtained in the frothed product and the non-desirable minerals in the non-frothing product. When a sufficient number (4–6) of repeated froth-flotations are carried out on the concentrate (frothed product), the desired quality of the final product is obtained. In this case, it is a lead sulfide concentrate in which Pb ~ 60%; Ag 4000–4500 g/t, the solid content in the slurry coming to the froth-flotation is preferably 25–35% of the weight of the slurry, i.e. 300–500 g solid/l of slurry.

The sulfidization and froth-flotation procedure described above, and described in greater detail later in examples, for the recovery of lead and silver from a ferritic leach residue is suitable, implemented in a corresponding manner, also for many other materials which contain lead and silver. It can be said in general that the process is suitable for all materials which contain lead and silver in the form of compounds which are more readily soluble than the respective sulfides. Usually the poorly soluble lead compound is lead sulfate and the poorly soluble silver compound is silver chloride. Such lead- and silver-bearing materials include the lead- and silver-bearing hematite-based solid phases produced in accordance with Finnish patent applications 80 3097 and 80 3098. In the former process, the solid phase is produced by an autoclave treatment, and in the latter, by a thermal treatment. Often sulfating roasting also produces similar lead- and silver-bearing hematite-based solid phases.

The recovery of lead, silver and gold by the process according to the invention is described in detail in the following examples.

EXAMPLE 1

5000 g of ferritic leach residue was slurried in 10 l of a $H_2SO_4$ solution in which the concentration of $H_2SO_4$ was 5 g/l. 300 g of moist PbS and 20 g of moist $Ag_2S$ were added to the slurry. The moisture content of the added sulfides was 40–50%. Such slurry was sulfidized in a closed reactor having powerful propeller mixing, temperature measurement, a sulfide-adding system and a water manometer for observing the pressure. In this case, 500 ml of a 2.5 M solution of $Na_2S$ was added to the slurry at an even rate in the course of three hours. During the sulfidization, the temperature was maintained at 50° C. At the end of the precipitation, the pH of the solution was 5.2. Prior to the sulfidization the ferritic leach residue contained zinc 22.4%, out of which 0.05% was water soluble and 0.16% soluble in acid, iron 41.2%, lead 4.8%, silver 300 g/t, and gold 1.7 g/t. After the addition of silver sulfide and lead sulfide, the concentration of silver in the mixture was 470 g/t and the concentration of lead 7.8%.

Using this sample, froth-flotation experiments were carried out as follows:

Experiment 1

The concentration of solids in the slurry was diluted to 30% using water. The slurry was fed into a froth-flotation cell, the pH was adjusted to 2 by means of $H_2SO_4$. A sulfide of a thiophosphate type collector (American Cyanamid, Aerofloat 242 promoter) was added to the slurry at 240 g/t and a TEB frothing agent at 60 g/l. This was followed by a preparation of about 1 min at the said pH, whereafter a pre-concentrate was froth-flotated (the frothing took about 15 min). The abovementioned collector agent was added to the residual slurry at 1100 g/t and TEB frothing agent at 210 g/t, and after a preparation of about 1 min a residual concentrate was froth-flotated and the treatment was repeated three times on the combined concentrates.

The following table shows the flows and compositions of the material fed to sulfidization, the material passing from sulfidization to froth-flotation, and the concentrate and froth-flotation residue, and the distribution of valuable metals in the froth-flotation.

Experiment 1

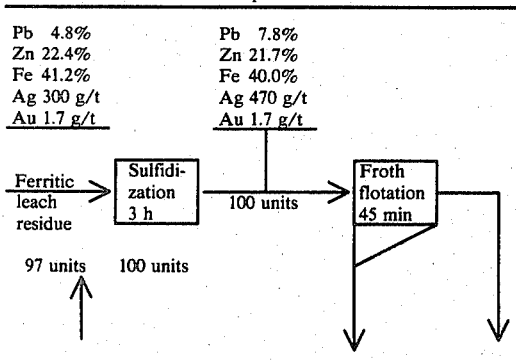

-continued

Experiment 1

| 3 units | | 10.8 units | | 89.2 units |
|---|---|---|---|---|
| Pbs $Ag_2S$ Nuclei | | | | Froth-flotation residue |
| | | | $KR_3$ % | 1.3 |
| | Pb | | R % | 14.9 |
| | | | g/t | 30 |
| | Ag | | R % | 5.8 |
| | | | g/t | 0.3 |
| | Au | | R % | 15.7 |
| | | | % | 23.3 |
| | Zn | | R % | 95.7 |
| | | | % | 44.1 |
| | Fe | | R % | 98.2 |

As can be seen from the above table, the sulfidization+-froth-flotation is a very effective and simple method for the recovery of the said valuable metals (in the above case, for example, the concentration of silver, in which the main value lies, has been increased nearly 9-fold, with a yield of about 95%.

Experiment 2

In this experiment the sulfidization and the material fed to the sulfidization were completely the same as in Experiment 1. A different sulfide collector, Aerophine 3418A (a phosphine derivative, manufacturer American Cyanamid Company), was used for the froth-flotation. The froth-flotation was carried out under conditions in other respects the same as in the previous example. Aerophine was used at 420 g/t in the preliminary froth-flotation, and at 180 g/t in the residual froth-flotation, and the TEB frothing agent at 60 g/t and at 100 g/t, respectively. The following result was obtained from the froth-flotation (pre-concentrate+residual concentrate retreated 4 times).

| | Feed | ($KR_4$) Pb—Ag sulfide concentrate | Froth-flotation residue |
|---|---|---|---|
| % by weight | 100 | 10.3 | 89.7 |
| Ag g/t | 468 | 4300 | 30 |
| Ag yield % | 100.0 | 95.0 | 5.0 |
| Pb % | 7.6 | 62.6 | 1.3 |
| Pb yield % | 100.0 | 84.8 | 15.2 |
| Zn % | 21.3 | 8.6 | 22.8 |
| Zn yield % | 100.0 | 4.2 | 95.8 |
| Fe % | 40.0 | 6.4 | 44.1 |
| Fe yield % | 100.0 | 1.7 | 98.3 |

It can be seen from the above table that the results (Ag-Pb yield/concentration) are in completely the same order as in previous Experiment 1, even though a different collector for sulfide minerals was used in this experiment than in the previous experiment, i.e. the type of the sulfide collector has no practical effect on the results.

Experiment 3

The following experiment is corroboration of this, since it was carried out using a xanthate collector, KEX (K-ethyl xanthate). It is known that the reistance of xanthates in a strongly acid milieu is not as good as that of, for example, thiophosphates. For this reason, this experiment was carried out at a pH of 3.5–4. The dispersion of the slurry was of essential significance for the selectivity of the froth-flotation, especially when treating a very finely-divided material as in this case (~98%-78 μm); 88%-37 μm, and ~50%-5 μm). When the pH value is raised to above 2–3, the above-mentioned difficulties are encountered. The difficulties can, however, be overcome by adding a suitable additional chemical (e.g. the method according to Finnish patent application No. 782017). In this case, 600 g/t of OK216 (dionylphenolethylene-oxiadduct, ethylene oxide 16 moles), which eliminates surface activity, was used, and it was added to the preparation together with the collector agent (KEX). Xanthate was used at 2000 g/t. The following table shows the result obtained.

| % by weight | Feed 100 | Pb—Ag sulfide concentrate ($KR_5$) 10.5 | Froth-flotation residue 89.5 |
|---|---|---|---|
| Ag g/t | 47.2 | 4200 | 34 |
| Ag yield % | 100.0 | 93.5 | 6.5 |
| Pb % | 7.8 | 61.5 | 1.5 |
| Pb yield % | 100.0 | 82.8 | 17.2 |
| Zn % | 20.8 | 8.8 | 22.2 |
| Zn yield % | 100.0 | 4.4 | 95.6 |
| Fe % | 39.8 | 6.8 | 43.7 |
| Fe yield % | 100.0 | 1.8 | 98.2 |

The result in the above table, together with the results of Experiment 1 and Experiment 2, shows, as noted above, that when the process according to the invention is used the result obtained is not dependent on the sulfide mineral collector used, nor is it dependent on the exact pH value of the experiment carried out in an acid milieu (pH 2–4). (Experiment 1 and Experiment 2, pH 2; Experiment 3, pH 3.5–4), if suitable known additional chemicals are used when necessary.

EXAMPLE 2

2000 g of a hematite precipitate obtained from thermal conversion (Finnish Patent Application 80 3098) was slurried in 5 l of a $H_2SO_4$ solution in which the concentration of $H_2SO_4$ was 5 g/l. 100 g of PbS and 500 mg of $Ag_2S$ were added to the slurry, the moisture content of the added sulfides being 40–50% $H_2O$. The arrangement of the previous example was used for the sulfidization of the precipitate, 200 ml of a 2.5 M $Na_2S$ solution being added at an even rate in the course of 3 hours. The temperature was maintained at 50° C. during the sulfidization. The pH of the solution was about 5 at the end of the precipitation.

The material fed to the sulfidization contained zinc 0.7%, iron 50.5%, lead 4.5% and silver 240 g/t. When $Ag_2S$ and PbS were added to the slurry, the concentrations were 6.9% lead, 380 g/t silver.

A froth-flotation experiment as in Experiment 2 was carried out using this material, and the following result was obtained.

| % by weight | Feed 100 | $KR_5$ Pb—Ag sulfide concentrate 10.8 | Froth-flotation residue 89.2 |
|---|---|---|---|
| Ag g/t | 380 | 3250 | 32 |
| Ag yield % | 100.0 | 92.5 | 7.5 |
| Pb % | 6.0 | 57.8 | 0.73 |
| Pb yield % | 100.0 | 90.5 | 9.5 |
| Zn % | 0.7 | 0.3 | 0.75 |
| Zn yield % | 100.0 | 4.6 | 95.4 |

-continued

| % by weight | Feed 100 | $KR_5$ Pb—Ag sulfide concentrate 10.8 | Froth-flotation residue 89.2 |
|---|---|---|---|
| Fe % | 50.5 | 18.8 | 54.3 |
| Fe yield % | 100.0 | 4.0 | 96.0 |

As can be seen from the table, the result obtained is completely in the same order as the results of the experiments of Example 1 as regards the yields of silver and lead. The lower concentration of silver in the final concentrate is, of course, due to the lower concentration of silver in the initial material.

EXAMPLE 3

In this case, the starting material for the sulfidization/froth-flotation process was a product, corresponding to the starting material of Example 2, obtained from an autoclave conversion (Finnish Patent Application No. 80 3097).

2700 g of a hematite-based precipitate obtained from an autoclave treatment was slurried in 10 l of a $H_2SO_4$ solution in which the concentration of $H_2SO_4$ was 5 g/l. 160 g of PbS and 1.2 g of $Ag_2S$ were added to the slurry. The moisture content of the added sulfides was 40–50% $H_2O$.

The sulfidization treatment was carried out in an apparatus in accordance with the previous examples, 250 ml of a 2.5 M solution of $Na_2S$ being added at an even rate in the course of 3 h. During the sulfidization, the temperature was 50° C., as in the previous experiments. At the end of the pecipitation, the pH of the solution was about 5.

The material going to sulfidization contained sulfur 0.6%, iron 51.4%, lead 4.0%, silver 203 g/t, and gold 0.6 g/t. After the $Ag_2S$ and PbS mentioned above were added to the solution, the silver concentration was 350 g/t and the lead concentration 6.8%.

A froth-flotation experiment was carried out on the material thus obtained in the manner of the previous example, and the following result was obtained.

| % by weight | Feed 100.0 | KR5 Ag—Pb sulfide concentrate 10.2 | Froth-flotation residue 89.8 |
|---|---|---|---|
| Ag g/t | 350 | 3200 | 27 |
| Ag yield % | 100.0 | 93.0 | 7.0 |
| Au g/t | 0.6 | 5.1 | 0.09 |
| Au yield % | 100.0 | 86.2 | 13.8 |
| Pb % | 6.8 | 60.7 | 0.68 |
| Pb yield % | 100.0 | 91.0 | 9.0 |
| Zn % | 0.6 | 0.3 | 0.63 |
| Zn yield % | 100.0 | 5.1 | 94.9 |
| Fe % | 51.4 | 19.0 | 55.1 |
| Fe yield % | 100.0 | 3.8 | 96.2 |

What is claimed is:

1. A process for the recovery of lead, silver and gold from the iron-bearing residue of an electrolytic zinc process, comprising first sulfidizing the ferritic leach residue selectively in order to convert at least the lead and silver substantially quantitatively to sulfides in a closed chamber by feeding into the slurry of the iron-bearing residue an amount of sulfide which is equivalent with regard to the amount of lead, silver and gold, in the presence of finely-divided nuclei of lead sulfide and silver sulfide in order to prevent lead sulfide and silver sulfide from precipitating on the surface of the compounds of lead and silver present in the ferritic leach residue; and then froth-flotating in a slurry of the sulfidized ferritic leach residue in the presence of a sulfidic collector agent in order to froth-flotate the sulfides and to separate them from the ferritic leach residue.

2. The process of claim 1, in which a part of the sulfide concentrate recovered by froth-flotation is returned to the sulfidization to serve as the said nuclei.

3. The process of claim 1, in which the sulfidization is carried out at an elevated temperature of 80° C. at maximum.

4. The process of claim 1, in which the sulfidization is carried out at a pH value of 3–6.

5. The process of claim 1, in which the sulfidization is carried out within 2–6 hours.

6. The process of claim 1, in which the sulfidized slurry is froth-flotated at a pH of 2–4 in the presence of a sulfide collector and a dispersing agent, as well as a frothing agent.

7. The process of claim 6, in which the froth-flotation is carried out at a pH of 2–3 in the presence of thiophosphate or a phosphine derivative.

8. The process of claim 6, in which the froth-flotation is carried out at a pH value of 3–4 in the presence of xanthate.

* * * * *

UNITED STATES PATENT AND TRADEMARK OFFICE

CERTIFICATE OF CORRECTION

PATENT NO. : 4,385,038

DATED : May 24, 1983

INVENTOR(S) : Jussi K. Rastas et al

It is certified that error appears in the above—identified patent and that said Letters Patent is hereby corrected as shown below:

Column 8, line 11:

"The air during" should read --The aim during--.

Signed and Sealed this

*Second* Day of *August 1983*

[SEAL]

*Attest:*

GERALD J. MOSSINGHOFF

*Attesting Officer*

*Commissioner of Patents and Trademarks*